United States Patent [19]

Takeda

[11] Patent Number: 4,723,392

[45] Date of Patent: Feb. 9, 1988

[54] VACUUM PACKAGING METHOD AND APPARATUS

[75] Inventor: Tadamichi Takeda, Mihara, Japan

[73] Assignees: Furukawa Mfg. Co. Ltd., Tokyo; ECS, Corporation, Hiroshima, both of Japan

[21] Appl. No.: 919,649

[22] Filed: Oct. 16, 1986

[51] Int. Cl.[4] ..... B65B 31/00

[52] U.S. Cl. ..... 53/434; 53/459; 53/512; 53/571

[58] Field of Search ..... 53/79, 91, 95, 96, 275, 53/373, 405, 432, 434, 469, 512, 571, 459

[56] References Cited

U.S. PATENT DOCUMENTS

| | | | |
|---|---|---|---|
| 3,910,009 | 10/1975 | Canfield | 53/95 X |
| 4,027,456 | 6/1977 | Wilson | 53/512 X |
| 4,033,093 | 7/1977 | Menacci | 53/512 |
| 4,580,393 | 4/1986 | Furukawa | 53/512 |
| 4,586,320 | 5/1986 | Takai et al. | 53/512 |
| 4,648,234 | 3/1987 | Bellini | 53/571 X |

*Primary Examiner*—Robert L. Spruill
*Assistant Examiner*—Steven P. Weihrouch
*Attorney, Agent, or Firm*—Barnes, Kisselle, Raisch, Choate, Whittemore & Hulbert

[57] ABSTRACT

Pressure resistant containers, each consisting of a pressure resistant box opened at the front surface thereof and a wall plate, are circulated along an endless track with the wall plates directed outward. The front and back surfaces of each wall plate are each provided with a clamp for supporting a soft pliable bag. The bag is fed to the clamp disposed outside the pressure resistant container, and the bag is clamped by the clamp. The mouth of the bag is then opened to fill the bag with an article. Subsequently, the wall plate is turned inside out to admit the bag in the pressure resistant container, and the bag is subjected to a vacuum in the pressure resistant container and the mouth of the bag is sealed.

10 Claims, 13 Drawing Figures

VACUUM PACKAGING METHOD AND APPARATUS

TECHNICAL FIELD OF THE INVENTION

The present invention relates to a vacuum packaging method and apparatus, wherein soft pliable packaging bags formed of thermoplastic material or the like are successively fed to clamps traveling along an endless track, said bags clamped by said clamps and conveyed along said endless track, during which time an article is filled into each bag through the upper opening in the bag and then the thus filled bag is enclosed by a pressure resistant container, the air in said container is sucked out by a vacuum pump to subject the article in said bag to a vacuum and finally the opening in said bag is sealed.

DESCRIPTION OF THE BACKGROUND

In the case where particulate articles or liquid-soaked articles, such as pickles, which tend to spill are to be packaged by an automatic packaging machine using bags which are unstable as compared with flat-bottomed self-standing bottles or cans, the essential condition is to clamp, suspend and stabilize the bag so that it will not fall down, as in the case of the packaging machine disclosed in U.S. Pat. Nos. 3,982,376 or 4,027,450. In said known packaging machine, a number of equispaced clamps are installed on an endless chain supported on two chain wheels, said clamps being circulated integrally with the chain by the driving force of said chain wheels, and along said chain there are installed a mechanism for feeding a bag to each clamp, a mechanism for opening the bag supported by the clamp, a mechanism for filling an article into the bag and a mechanism for sealing the opening in the bag filled with the article; thus, an article tending to spill can be automatically packaged in an unstable bag.

The aforesaid full automatic packaging machine could be relatively easily provided with a vacuum packaging function. This provision could be made, for example, by supporting on a chain a number of pressure resistant containers adapted to be opened and closed and enclose said clamps, conveying said pressure resistant containers by said chain, successively closing said pressure resistant containers between the mechanism for filling an article into each bag and the mechanism for sealing the opening in the filled bag, and successively sucking out the air in the pressure resistant containers. With the packaging machine adapted to perform bag feeding operation, bag opening operation, filling operation, evacuating operation and sealing operation along the endless track as described above, however, it takes a considerable time to reduce the pressure in the pressure resistant container from the atmospheric pressure to a vacuum, during which time the pressure resistant container will travel a considerable distance along the endless track, making it necessary to correspondingly prolong the endless track, thus entailing a disadvantage that the packaging machine is increased in size.

The present invention has for its object the provision of a vacuum packaging method which makes it possible to shorten the endless track and reduce the size of the packaging machine.

DISCLOSURE OF THE INVENTION

According to the invention, to achieve the aforesaid object, the front and rear surfaces of a wall plate which forms part of a pressure resistant container are utilized so that feeding, bag opening and filling are preformed outside the wall plate and evacuation inside the wall plate. More particularly, the method comprises preparing boxes, each having one of its surfaces opened, which are disposed on an endless track with their open surfaces directed outward, each open surface having a wall plate air-tightly provided thereon, integrally moving said wall plates and said boxes along said endless track, the inner and outer surfaces of said wall plate being each provided with a clamp mechanism for supporting a bag, during the time said box and wall plate make one round along the endless track, evacuating a pressure resistant container consisting of said box and wall plate to subject to a vacuum an article in a bag supported by the clamp mechanism on the inner surface of the wall plate, sealing the opening in said bag, introducing air into said pressure resistant container, separating said wall plate from said box, turning said wall plate inside out, intimately contacting said wall plate with the opening in said box, while, during the time the bag supported by the clamp mechanism on the inner side of the wall plate is evacuated as described above, on the outer side of the wall plate, removing the vacuum packaged article from the clamp mechanism, feeding a fresh bag to the latter clamp mechanism, and filling said bag with an article.

According to the invention, during the time each pressure resistant container makes one round along said endless track, the pressure resistant container is evacuated while, outside the pressure resistant container, a bag is fed to the clamp mechanism and an article is filled into said bag. At a station where the air is filled into the bag, the wall plate is turned inside out, and the vacuum packaged article which has been inside the pressure resistant container is discharged into the outside of the pressure resistant container while, in contrast, the unsealed bag disposed outside the container is received in the pressure resistant container. Each time the pressure resistant container makes one round along the endless track, the wall plate is turned inside out, whereupon the feeding of a fresh bag to the clamp and the filling of an article into the bag outside the pressure resistant container and the evacuation and sealing inside the pressure resistant container, are parallelly effected by utilizing the inner and outer surfaces of the wall plate, as described above; therefore, as compared with the conventional packaging machine which serially performs these operations, the endless track can be correspondingly reduced in length; thus, there is a merit that this type of rotary vacuum packaging machine can be reduced in size.

DESCRIPTION OF THE DRAWINGS

Throughout the figures, like or common elements are indicated by like reference characters.

DESCRIPTION OF THE EMBODIMENTS

Preferred embodiments of the invention will now be described.

Figure 1:
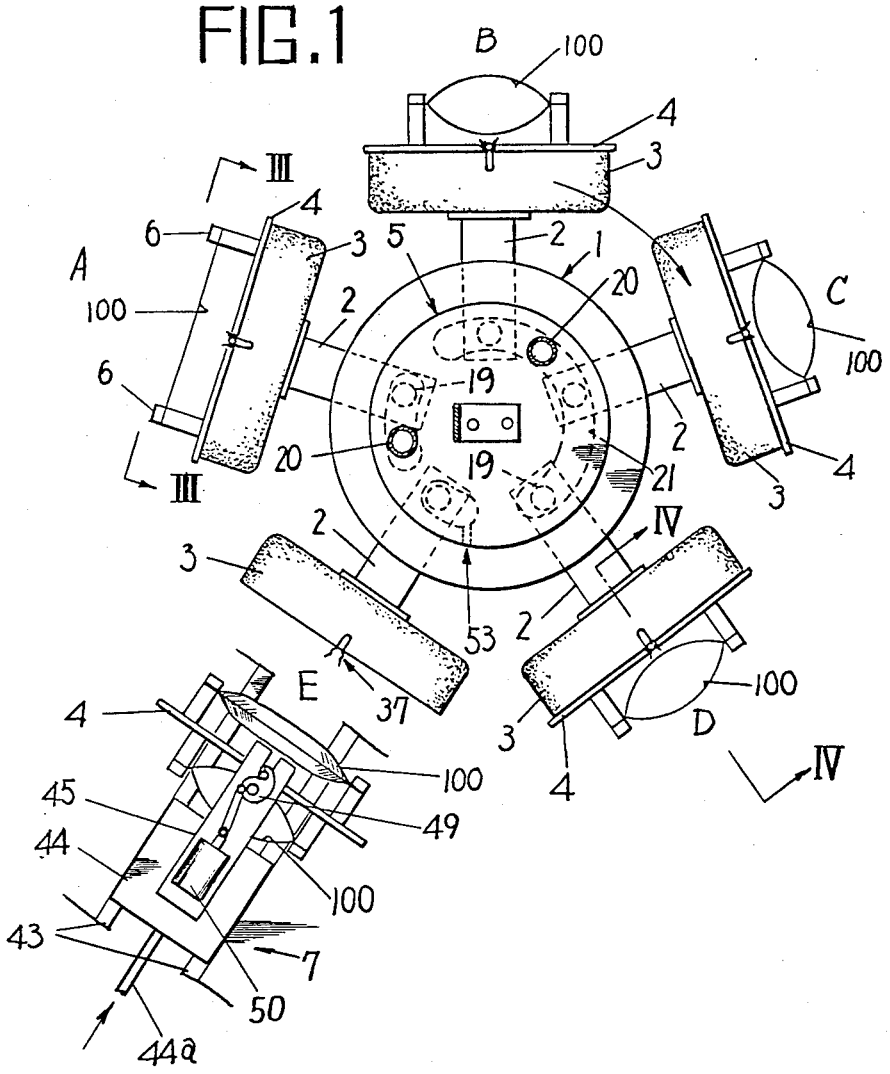
FIG. 1 is a plan view of an apparatus for embodying the present invention.

FIG. 1 is a plan view of a vacuum packaging apparatus comprising five equispaced square pipes 2 radially extending from the lower surface of a rotor 1 in the form of a flat circular plate, pressure resistant boxes 3 respectively attached to the front ends of said square pipes 2, a wall plate 4 serving as a cover plate and airtightly contacted with the open surface of each said box 3 by differential pressure, and a rotary valve 5 installed on the central region of said rotor 1.

Figure 2:
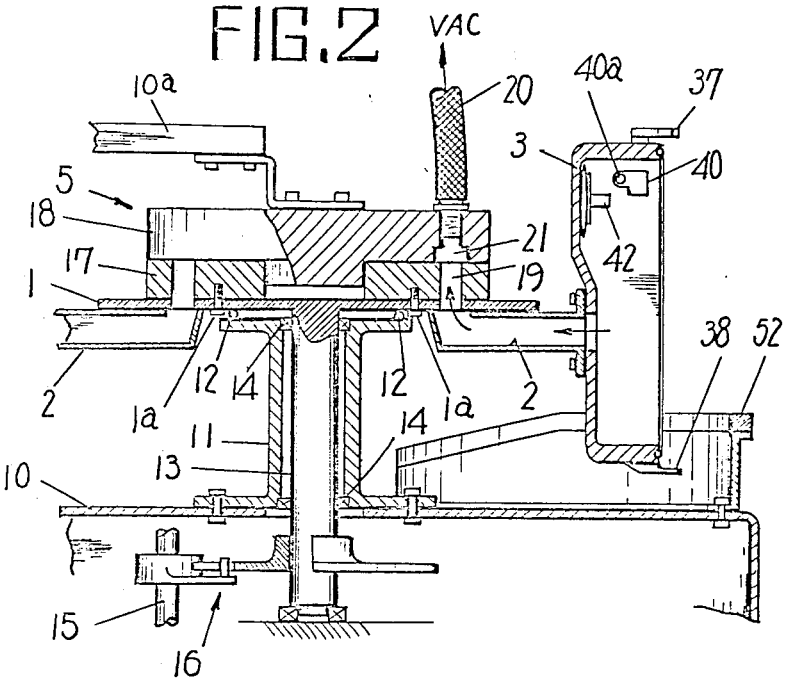
FIG. 2 is an enlarged sectional view through the center of the preceding figure.

FIG. 2 is a sectional view of the preceding figure, wherein on the upper surface of a cylindrical bearing 11 erected on the upper surface of a machine frame 10, said rotor 1 is rotatably installed through a thrust bearing 12, and a main shaft 13 depending from the lower central region of said rotor 1 is supported in said bearing 11 through radial bearings 14, the lower end of said main shaft 13 being connected through a Geneva mechanism 16 to a driving shaft 15 supported inside the machine frame 10. The rotary valve 5 comprises a doughnut-shaped movable disk 17 fixed on the upper surface of the rotor 1 by bolts 1*a*, and a fixed disk 18 placed on said movable disk 17 and firmly supported on the machine frame 10 by an arm 10*a*. Five passageways 19 vertically extending through the movable disk 17 respectively communicate with the boxes 3 through the pipes 2, while the fixed disk 18 has boses 20 connected thereto, the other ends of said boses 20 being connected to a vacuum source, and the lower surface of said fixed disk 18 is formed with arcuate grooves 21 leading to said hoses 20.

Thus, the rotating drive power of the driving shaft 15 is transmitted to the rotor 1 through the main shaft 13. In this case, by the intermittent power transmitting function of the Geneva mechanism 15, the five pressure resistant containers, each consisting of a box 3 and a wall plate 4, are intermittently rotated clockwise in FIG. 1 in increments of 72 degrees. During the time the passageway 19 communicates with the arcuate groove 21, a vacuum acts in the pressure resistant container, but when said passageway 19 is connected to an air introducing port 53, the air is introduced into the pressure resistant container.

Figure 3:
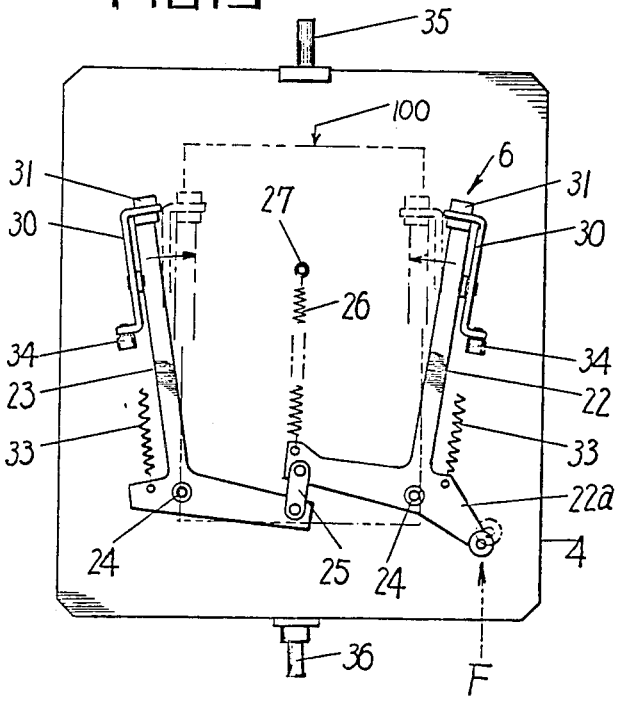
FIG. 3 is a sectional view taken along the line III—III in FIG. 1.
Figure 4:
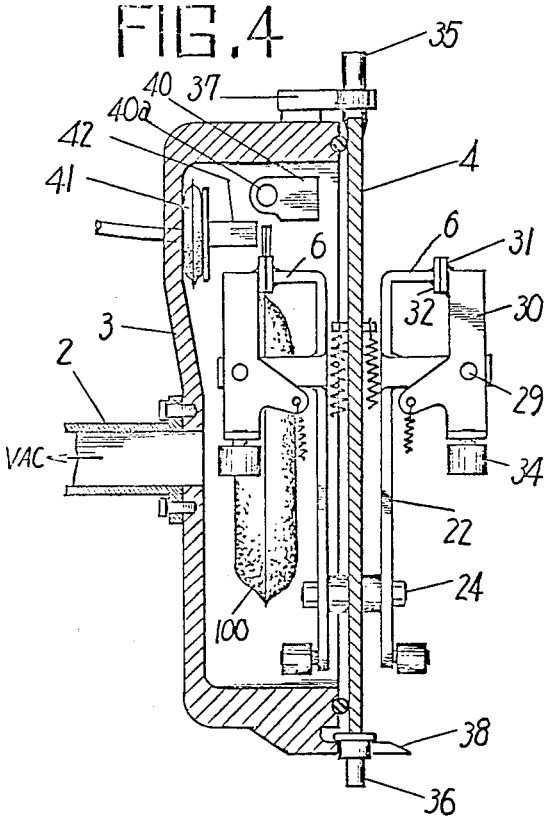
FIG. 4 is a sectional view of a pressure resistant container, taken along the line IV—IV in FIG. 3.

FIG. 3 shows the wall plate 4 for the pressure resistant container. The upper and lower ends of said wall plate are centrally provided with pins 35 and 36, respectively, projecting therefrom, while the front surface of said wall plate 4 is provided with a clamp 6 for clamping a bag 100. In addition, as shown in FIG. 4, the wall plate 4 is provided with clamps 6 respectively on its front and back surfaces, and since these two clamps 6 are of the same construction, the one on the front surface shown in FIG. 3 will be described, a description of the other on the back surface being omitted. The clamp 6 comprises a pair of L-shaped arms 22 and 23 pivotally connected to the wall plate 4 by pins 24, the opposite ends of the lower sides of said arms 22, 23 being interconnected by a link 25, and a tension spring 26 engaged at one end thereof with the inner end of the arm 22 and at the other end thereof with a pin 27 fixed on the wall plate 4, the spring 26 urging the upper ends of the arms 22 and 23 to move away from each other. If an external force F is applied to the lower side of a piece 22*a* projecting laterally from the lower side of one arm 22, the spring 26 is stretched and the upper ends of the arms 22 and 23 move toward each other, as shown in phantom lines, making it possible to catch the bag 100 by a clip to be described below.

Figure 5:
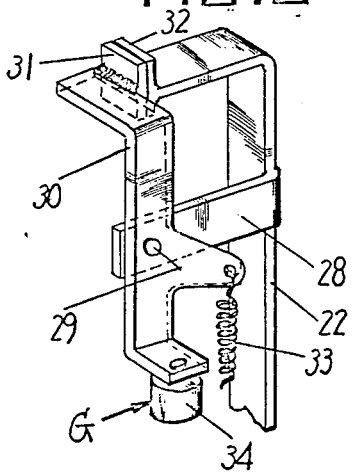
FIG. 5 is a perspective view of part of a clamp mechanism.

Since the clips installed on the upper ends of the pair of arms 22 and 23 are of the same construction, only one of them is shown in FIG. 5, the other being omitted from illustration. The clip comprises a movable member 30 rotatably supported on a pin 29 fixed on a bracket 28 extending laterally from the arm 22, pawl plates 31 and 32 fixed on the upper ends of said movable member 30 and said arm 22, respectively, and a spring 33 applying a force to the movable member 30 to exert a clamp force between said pawls 31 and 32. Thus, if an external force in the direction of arrow G is applied to a roller 34 installed on the lower end of the movable member 30, the pawls 31 and 32 are opened to allow the clamped bag 100 to fall down.

As shown in FIG. 4, a U-shaped spring clip 37 is installed on the upper surface of the box 3 for clipping the pin 35 on the upper side of the wall plate 4, while the pin 36 on the lower side of the wall plate 4 can be fitted in a fork 38 formed on the lower surface of the box 3. As a result, even if no vacuum acts in the interior of the box 3, the wall plate 4 can be supported. A seal block 40 and a seal bar 42 are installed in the inner upper region of the box 3. The seal block 40 is rotatably supported on the lateral surface of the box 3 by a shaft 40*a*. The opening in the bag 100 can be sealed by being clamped between the seal bar 42 which is displaced by applying a fluid pressure to the interior of a flexible tube 41 and the seal block 40 which is rotated by an operating force applied to the shaft 40*a*.

As already described with reference to FIG. 1. the five pressure resistant containers are intermittently revolved in increments of 72 degrees and successively stop at stations indicated by the five letters A, B, C, D and E in the alphabet. At one station A, there is a bag feeding mechanism for feeding bags 100 to the clamps 6 on the outer side of the wall plate 4. This bag feeding mechanism is of the construction in which a number of stacked bags are sucked one by one from the top by a vacuum cup and fed to the clamps 6 at predetermined intervals of time, and since it is known in the field of packaging techniques, the detailed construction thereof is omitted from illustration. In this case, a bag can be fed between the pawls 31 and 32 which can be temporarily opened by applying an operating force G to the roller 34, as shown in FIG. 5.

In the three stations B, C, and D the bag 100 supported is kept open. As already described with reference to FIG. 3, by applying an operative force F to the lower end of the arm 22, the two arms 22 and 23 on opposite sides are moved toward each other to reduce the width of the bag, whereby the bag is automatically opened. For this purpose, a cam 52 in the form of a cylindrical rail is installed on the upper surface of the machine frame 10, said cam 52 being adapted to apply a pressure F to the arm 22. Instead of the cam 52, an air cylinder may be utilized to produce the operative force F. In addition, it is often practiced to feed air into the bag 100 to assist in opening the bag 100.

At the next station C where the bag 100 arrives in its opened state, there is an article filling mechanism. This filling mechanism comprises a hopper and a weighing unit vertically movable at predetermined intervals of time. When the bag 100 is stopped, the discharge sleeve of the hopper is inserted into the opening in the bag 100 and an article weighed in fed into the bag 100 through the hopper.

At the next station D, there is a liquid feeding mechanism which feed an article additive liquid to the bag 100.

When the bag 100 approaches the next station E, air flows from the air introducing port 53 into the pressure resistant container, making the box 3 and wall plate 4 separable from each other. In this station, a wall plate turning-out mechanism 7 is installed.

Figure 6:
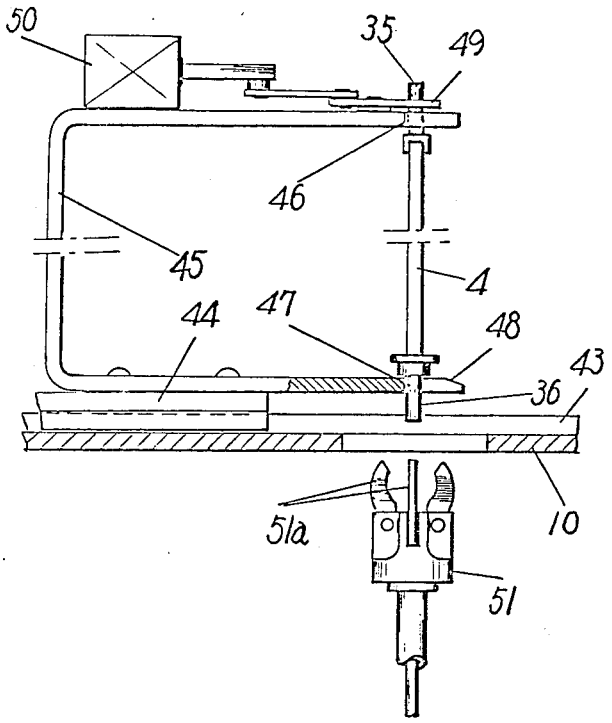
FIG. 6 is a side view of a wall plate turning-out mechanism.
Figure 7:
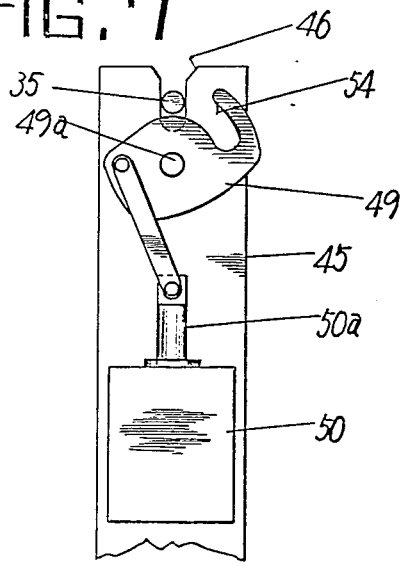
FIG. 7 is a plan view of part of the preceding figure.

The aforesaid mechanism 7, as shown in FIG. 6, comprises a slide block 44 engaged with a rail 43 laid on the machine frame 10, a U-shaped frame 45 fixed on said slide block 44, a rotary lock 49 operable by an electromagnetic solenoid 50 mounted on said frame 45, and a rotary chuck 51 disposed under the machine frame 10. Two ends of said frame 45 are formed with cuts 46 and 47, as shown in FIG. 7, for receiving the upper and lower pins 35 and 36 of the wall plate 4, and particularly a fork 48 formed in the lower end of the frame 45 holds the wall plate 4. The rotary lock 49 rotatably supported by the frame 45 through a pin 49*a* has a hook 54 formed at the front end thereof, which hook 54 is adapted to catch the pin 35 when the core 50*a* of the electromagnetic solenoid is moved.

When the pressure resistant container stops at the station E opposed to the wall plate turning-out mechanism 7 in FIG. 1, a pushing force is applied to the block 44 through a rod 44*a*, urging the frame 45 to move together with the block 44 along the rail 43 toward the pressure resistant container. The cuts 46 and 47 in the upper and lower ends engage the upper and lower pins 35 and 36 of the wall plate 4 and at the same time the rotary lock 49 is rotated by the solenoid 50 to cause the hook 54 to engage the pin 35. When such a state is established, the block 44 is retracted along the rail 43 to the position shown in FIG. 6. Positioned below is the rotary chuck 51 having four fingers 51*a*, said rotary chuck 51 being then moved upward and the fingers 51*a* grip the pin 36 and rotate the wall plate 4 through 180 degrees. The wall plate 4 thus turned inside out is pushed again against the open surface of the box 3 by the forward movement of the block 44 and, as shown in FIG. 4, is supported on the open surface of the box 3 by the spring clip 37. At the same time, the rotary lock 49 releases the pin 35 and is retracted to its original position, where it stands by for the next operation.

The bag 100 containing the article and additive liquid is perfectly sealed in the pressure resistant container formed by the box 3 and wall plate 4. During the time the pressure resistant container is moved along the circular endless rail by the rotation of the rotor 1, it is evacuated and the seal block 40 is rotated by an external operating force while the seal bar 42 is actuated to heat seal the mouth of the bag 100. During this time, a fresh bag is fed to the clip on the outer side of the wall plate 4 and is filled with an article. At the station E where the wall plate turning-out mechanism 7 is installed, the wall plate 4 is separated from the box 3 and turned inside out again. As described above, vacuum packaging operation is performed on the inner side of the wall plate 4, while on the outer side of the wall plate 4 the preparatory packaging operation including the discharging of the vacuum packaged article, the feeding of a fresh bag and the filling of an article is performed.

In FIG. 1 the construction for separating the wall plate 4 from the box 3 and turning it inside out has been shown and in FIGS. 2 through 7 and embodiment related thereto has been shown. Shown in FIGS. 8 through 13 to be described below is an embodiment which, unlike the preceding one, is capable of turning the wall plate inside out while allowing the wall plate to remain connected to the box. In such an embodiment, it is possible to prevent the wall plate from falling down when the differential pressure disappers.

Figure 8:
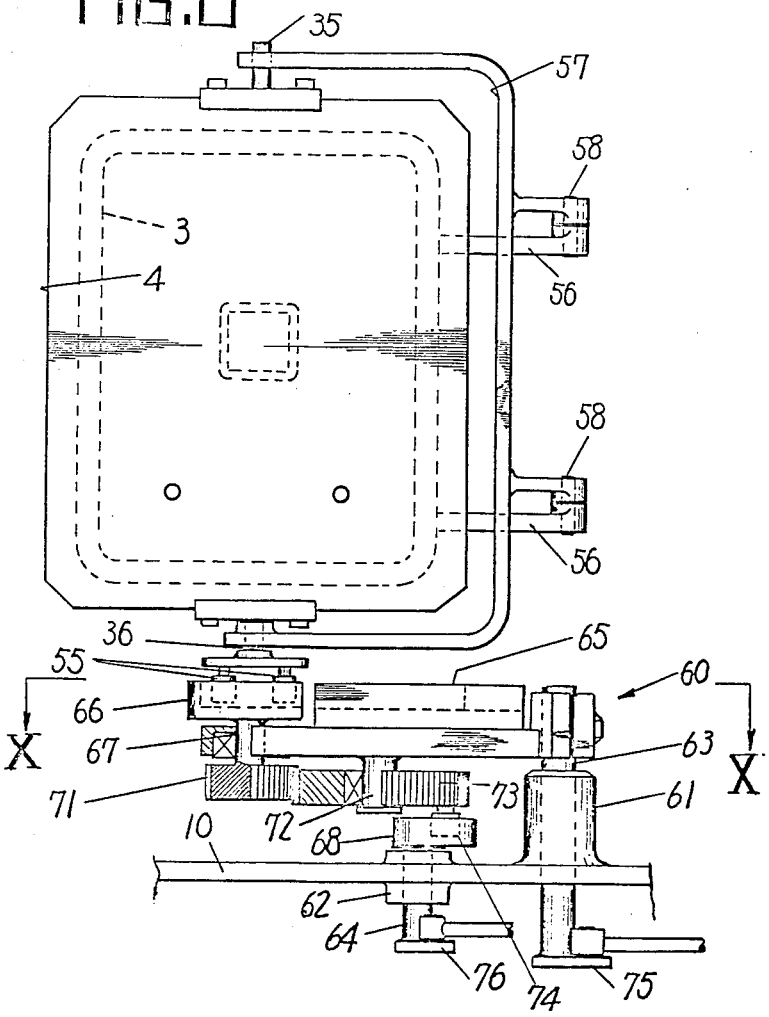
FIG. 8 is a front view of a pressure resistant container in another embodiment.
Figure 9:
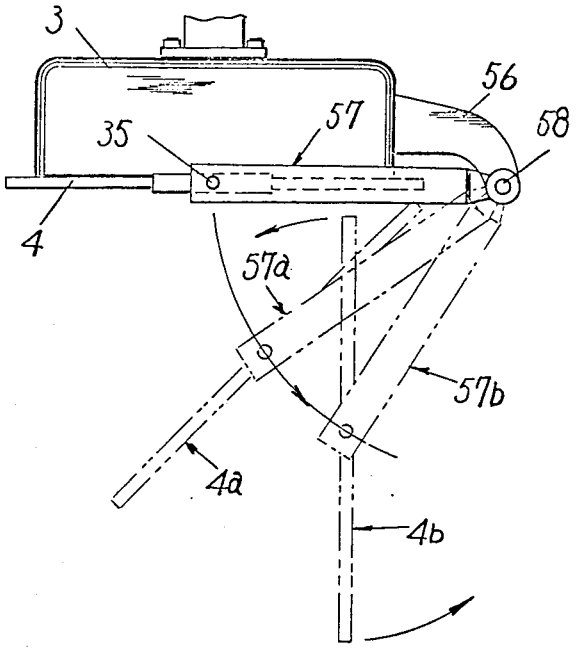
FIG. 9 is a plan view of the preceding figure.

More particularly, two brackets 56, upper and lower, are installed on a lateral surface of the box 3 shown in dotted lines in FIG. 8, said brackets 56 rotatably supporting at their front ends a substantially C-shaped frame 57 through pins 58, the upper and lower sides of said frame 57 rotatably supporting the upper and lower pins 35 and 36 of the wall plate 4. Supporting the wall plate 4 on the box 3 though the frame 57 in this manner makes it possible to separate the frame 57 from the box 3 around the axes of the pins 58 as indicated by phantom lines 57*a* and 57*b* in FIG. 9 while rotating the wall plate 4 around the axis of the pin 35 as indicated by phantom lines 4*a* and 4*b*; the wall plate 4, turned inside out, can be brought into intimate contact with the open surface of the box 3 again. In this embodiment, the front and back surfaces of the wall plate 4 are provided with clamps for supporting a bag, but such clamps are omitted from illustration for the sake of simplicity of illustration.

Figure 10:
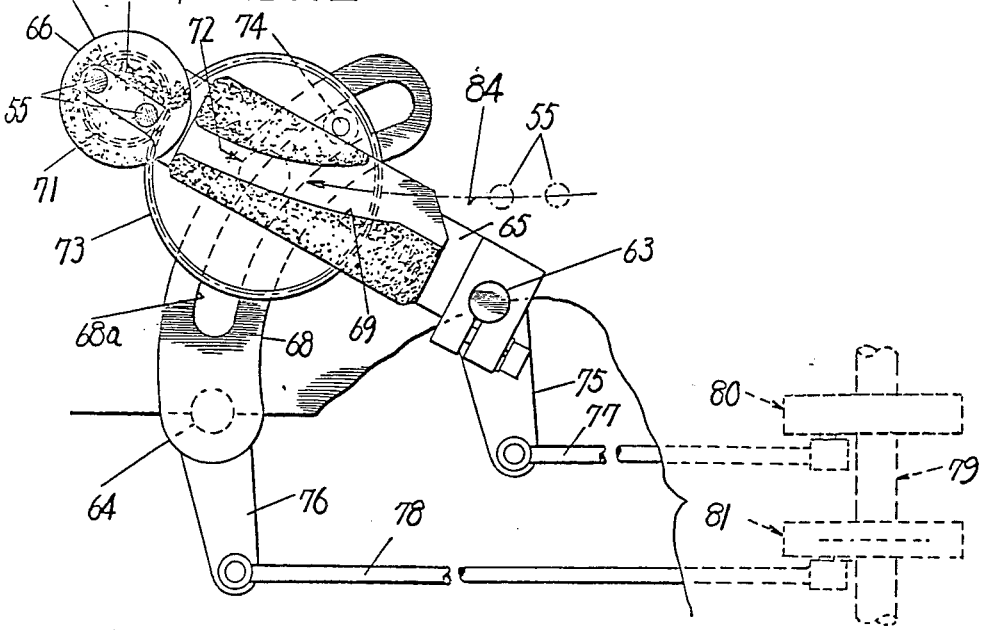
FIG. 10 is a view taken along the line X—X in FIG. 8.
Figure 13:
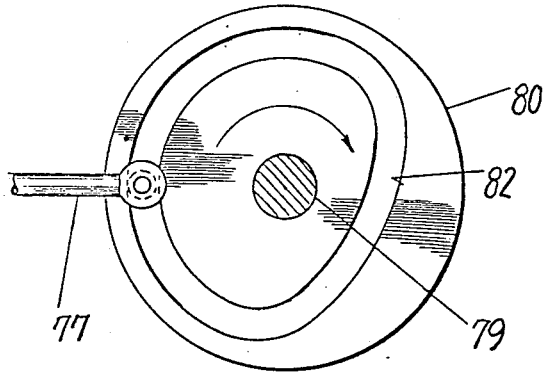

A wall plate turning-out mechanism 60 shown in FIG. 8 comprises short shafts 63 and 64 supported in two bearings 61 and 62 installed on the machine frame 10, an arm 65 fixed on the upper end of one shaft 63 with a turn block 66 rotatably supported at the front end of said arm 65 through a pin 67, as shown in FIG. 10, and an arcuate swing rail 68 installed on the upper end of the other shaft 64 for rotating said turn block 66. The upper surface of said arm 65 is formed with a guide groove 69 which genetly curves, while the upper surface of the turn block 66 is formed with a bottomed slit 70. When the arm 65 is fixed so that said guide groove 69 is aligned with an endless track 84 along which the pressure resistant containers are moved, two rollers 55 disposed on the under side of the pin 36 of the wall plate 4 slide from the guide groove 69 into the slit 70 and stop there. A gear 71 of small diameter provided on the lower end of the central pin 67 of the turn block 66 meshes with a drive gear 73 of large diameter supported on the lower surface of the arm 65 through a pin 72. The drive gear 73 has a pin 74 depending from the lower surface thereof adjacent its peripheral edge, said pin 74 engaging the groove-like rail 68*a* of the swing rail 68. The shaft 63 of the arm 65 and the shaft 64 of the swing arm 68 have levers 75 and 76, respectively, fixed to their lower ends, said levers 75, 76 having connecting rods 77 and 78 connected thereto, the front ends of said connecting rods 77 and 78 engaging groove cams 80 and 81, respectively, fixed on a rotary shaft 79. The design of the cams is such that the time required for said rotary shaft 79 to make one revolution is equal to the time required for the pressure resistant container to move through 1 pitch (72 degrees). A groove 82 formed in the cam 80 shown in FIG. 13 is designed so that an angular extent of about 180 degrees approaches the rotary shaft 79 to pull the connecting rod 77 toward the center of the cam 80.

Figure 11:
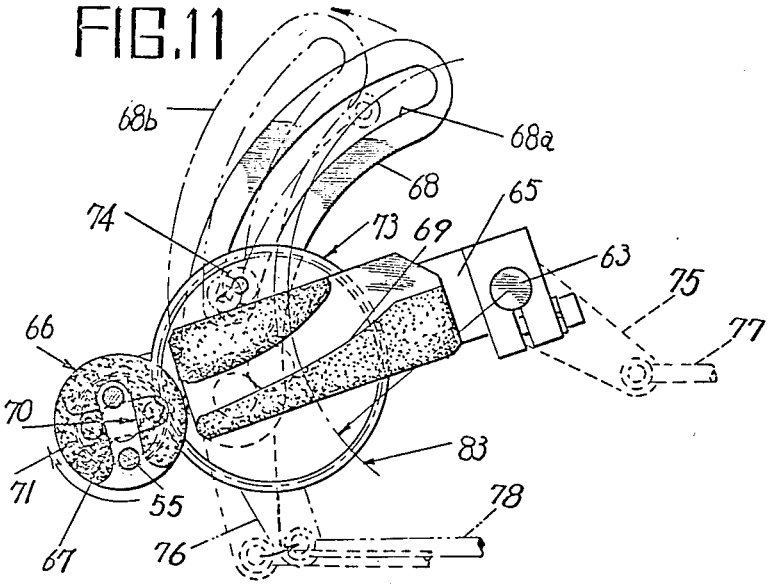
FIGS. 11 through 13 are views for explaining the operation in the preceding figure.
Figure 12:
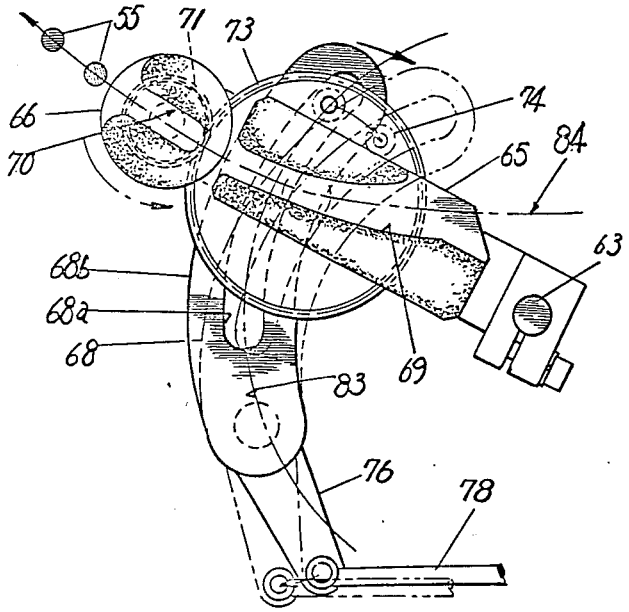

Thus, in FIG. 10, when the rollers 55 moving along the endless track 84 are guided in the slit 70 and stop there, the shaft 63 is rotated by the groove cam 80 to swing the arm 65 counterclockwise in FIG. 10. As a result, the wall plate 4 is separated from the box 3 as indicated by phantom lines in FIG. 9. FIG. 11 shows the position at which the arm 85 swung by the shaft 63 stops. The groove-like rail 68*a* crosses the truly circular path 83 described around the axis of the shaft 63, and when the arm 65 is swung counterclockwise in FIG. 11, the pin 74 installed on the drive gear 73 is moved along the groove-like rail 68*a;* therefore, the drive gear 73 is rotated counterclockwise as viewed in FIG. 11 by an amount corresponding to the amount of deviation of the groove-like rail 68*a* from the truly circular path 83, thereby rotating the turn block 66 through the intermediary of the driven gear 71. (As a result, the slit 70 is rotated through about 90 degrees.) Subsequently, the swing rail 68 is swung to a phantom line position 68*b* by the groove cam 81, further rotating the drive gear 73 through the pin 74, so that the turn block 66 is further rotated through an angle of 90 degrees. The result is that the wall plate is turned inside out by the turn block 66. Subsequently, the arm 65 is retracted until the guide groove 69 is aligned with the endless track 84, as shown in FIG. 12. By such function, the wall plate 4 is intimately contacted with the open surface of the box 3. In this case, since the groove-like rail 68*a* is positioned along the true circle 83 described around axis of the shaft 63, no turning force acts on the turn block 66. The pressure resistant container is moved to the next station, with the rollers 55 leaving the slit 70. Then, the swing rail 68 is swung from the solid line position 68*b* to the phantom line position 68, and the turn block 66 is rotated through 180 degrees by a relatively small angle of rotation of the drive gear 73, the whole being brought back to the FIG. 10 state to prepare for the next arrival of the rollers 55.

What is claimed is:

1. A method of vacuum packaging an article in a relatively soft pliable bag, comprising the steps of preparing boxes, each having one of its surfaces opened, for admitting said article and bag, which are disposed on an endless track with their open surfaces directed outward, each open surface having a wall plate air-tightly provided thereon, the inner and outer surfaces of said wall plate being each provided with a clamp for supporting a bag, moving pressure resistant containers, each consisting of said box and wall plate, along said endless track, while said pressure resistant container makes one round along the endless track, evacuating the pressure resistant container to subject to a vacuum the article in the bag supported by the clamp on the inner surface of the wall plate, sealing the opening in said bag, introducing air into said pressure resistant container, separating said wall plate from said box, turning said wall plate inside out to take out the vacuum packaged article from the pressure resistant container, intimately contacting said wall plate with the opening in said box, during the same time that said pressure resistant container makes one round along the endless track, removing a vacuum packaged article from the clamp on the outer surface of a wall plate, such vacuum packaged article having been packaged during the previous round of the pressure resistant container, feeding a fresh bag to the clamp on the outer surface of said wall plate, filling said fresh bag with an article, and admitting the fresh, article filled bag into a pressure resistant container by said separating and turning motion of the wall plate.

2. A method as set forth in claim 1, wherein the endless track along which the pressure resistant containers travel is of a truly circular type, said pressure resistant containers being circulated along this truly circular type track in such a manner that they travel intermittently each time an equal angular distance and then stop.

3. a method as set forth in claim 1, wherein said wall plate is completely separated from the box and then turned inside out, whereupon it is brought back to the box.

4. A method as set forth in claim 1, wherein said wall plate is adapted to be turned inside out while remaining connected to the box.

5. A vacuum packaging apparatus suitable for vacuum packaging an article in a soft pliable bag, operated by supporting a soft pliable bag by a clamp with the bag opening directed upward, filling an article into said bag through said opening, causing a vacuum to act around said bag, and sealing the bag opening, said apparatus comprising a number of boxes equispaced along an endless track with the opening surfaces of said boxes directed outward, a number of wall plates respectively supported on and intimately contacted with the open surfaces of said boxes, clamps installed on the inner and outer surfaces of each wall plate for holding bags, means for intermittently conveying said boxes together with said wall plates each time a distance equal to the installation spacing of said boxes, means for feeding a fresh bag to the clamp on the outer surface of the wall plate and causing said clamp to clamp said bag at the first station where said box stops, means for opening the mouth of said bag clamped by the preceding means and filling an article into said bag at the second station where said box stops, the second station being located ahead of the first station, means for separating said wall plate from said box, turning said wall plate inside out and air-tightly intimately contacting the wall plate in the turned out state with the open surface of said box again to admit the bag and the article into the box at the third station where the box stops, the third station being located ahead of the second station and prior to the first station along by the endless track, means for subjecting the article to a vacuum by the function of evacuating said box and then sealing the opening in said bag while said box makes one round along the endless track and the preparatory packing operation for a fresh bag is performed on the outer side of the wall plate, and means for removing the vacuum packaged article from the clamp on the outer side of the wall plate after the vacuum packaged article is taken out from the box at the third station according to the separating and turning motion of the wall plate.

6. A vacuum packaging apparatus as set forth in claim 5, wherein the open surface of said box is provided with an engaging mechanism for engaging the wall plate to prevent said wall plate from falling down, and said apparatus comprises a wall plate turning-out mechanism for catching said wall plate to separate it from the box and turning said wall plate inside out and then returning it to the box.

7. A vacuum packaging apparatus as set forth in claim 6, wherein pins projecting from the upper and lower sides of the wall plate are engaged by a fork provided under the open surface of the box and by a spring clip provided above the open surface of the box.

8. A vacuum packaging apparatus as set forth in claim 5, wherein upper and lower pins project from the upper and lower sides of said wall plate, a slide block which is reciprocated along a rail to move toward and away from the box is provided with a mechanism for arresting the upper and lower pins of said wall plate, and said apparatus comprises a mechanism for catching the lower pin at a position when said slide block is farthest from the pressure resistant container and turning the wall plate inside out.

9. A vacuum packaging apparatus as set forth in claim 5, wherein a frame larger than the open surface of the box and turnably supported by a lateral side of the box through pins is separably placed over said open surface, and the pins projecting from the upper and lower sides of the wall plate disposed inside said frame are engaged with said frame, the arrangement being such that said frame and said wall plate can be integrally separated from the open surface and the wall plate turned inside out while remaining supported by the frame.

10. A vacuum packaging apparatus as set forth in claim 9, wherein the upper surface of an arm adapted to be swung horizontally by a shaft at one end is formed with an arcuate type guide groove which guides the pin projecting from the lower side of the wall plate, the terminal end of said guide groove is rotatably provided with a turn block adapted to arrest said pin, a gear of relatively small diameter mounted on the rotary shaft of said turn block meshes with a gear of large diameter supported on said arm, while an arcuate type swing rail supported at one end thereof by a drive shaft is engaged with a pin projecting from said large diameter gear, the arrangement being such that when said arm is swung by the shaft at one end thereof and the frame is rotatively separated from the open surface of the box through the wall plate arrested by the turn block at the front end, the function of said swing rail is amplified and transmitted to the small diameter gear through the large diameter gear and the turn block connected to the small diameter gear is turned to turn the wall plate inside out.

* * * * *